US011634930B2

(12) United States Patent
Schnarr et al.

(10) Patent No.: US 11,634,930 B2
(45) Date of Patent: Apr. 25, 2023

(54) ELECTRIC STRIKE INSTALLATION TOOL AND METHOD

(71) Applicant: DORMAKABA CANADA INC., Montréal (CA)

(72) Inventors: Robert P. Schnarr, Cambridge (CA); Mandeep Singh, Kitchener (CA)

(73) Assignee: DORMAKABA CANADA INC., Montréal (CA)

( * ) Notice: Subject to any disclaimer, the term of this patent is extended or adjusted under 35 U.S.C. 154(b) by 231 days.

(21) Appl. No.: 17/075,223

(22) Filed: Oct. 20, 2020

(65) Prior Publication Data

US 2021/0246688 A1 Aug. 12, 2021

Related U.S. Application Data

(60) Provisional application No. 62/972,340, filed on Feb. 10, 2020.

(51) Int. Cl.

| | |
|---|---|
| ***E05B 17/06*** | (2006.01) |
| ***B21D 28/34*** | (2006.01) |
| ***B21D 28/26*** | (2006.01) |
| *E05B 47/00* | (2006.01) |

(52) U.S. Cl.
CPC ..... *E05B 17/06* (2013.01); *B21D 28/26* (2013.01); *B21D 28/34* (2013.01); *B21D 28/343* (2013.01); *E05B 47/0046* (2013.01)

(58) Field of Classification Search
CPC ..... B21D 28/34; B21D 28/26; B21D 28/243; B21D 28/348; E05B 17/06; E05B 47/0046
USPC ..... 83/13; 30/360
See application file for complete search history.

(56) References Cited

U.S. PATENT DOCUMENTS

| | | | | |
|---|---|---|---|---|
| 2,352,211 A * | 6/1944 | Paulkratzmaier | ..... | B21D 28/34 83/98 |
| 3,494,033 A * | 2/1970 | Bosco | ..... | B21D 28/343 30/360 |
| 4,074,432 A * | 2/1978 | Alfieri | ..... | B21D 28/343 30/360 |

* cited by examiner

*Primary Examiner* — Nhat Chieu Q Do
(74) *Attorney, Agent, or Firm* — Alexandre Daoust; Norton Rose Fulbright Canada LP

(57) ABSTRACT

A lock jamb punching tool includes a face member having a die aperture, a rabbet member protruding normal to the face member, a jamb area between the rabbet member and the face member, and a punch in the jamb area, the punch being slidable into the die aperture along a punch path, and an actuator to move the punch along the punch path.

14 Claims, 5 Drawing Sheets

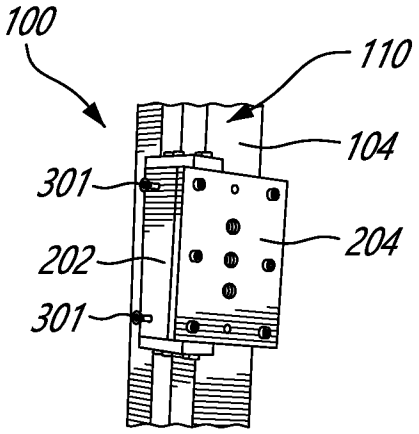
FIG. 3A
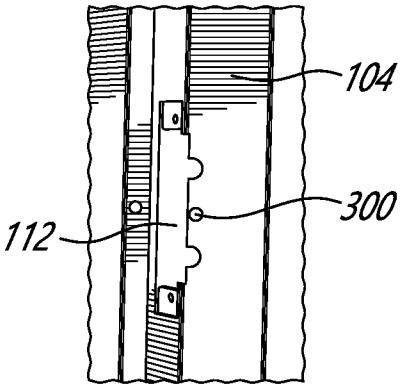
FIG. 3B
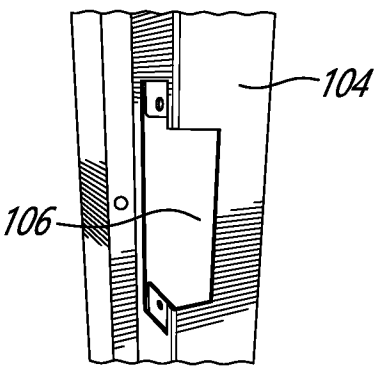
FIG. 3C
FIG. 3D
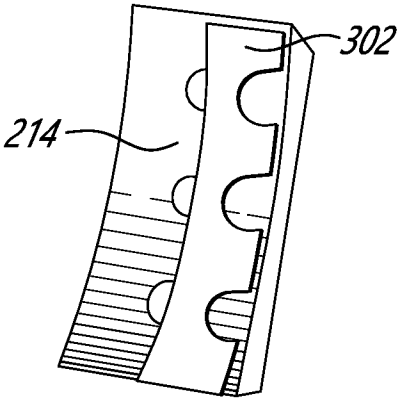
FIG. 3E

ELECTRIC STRIKE INSTALLATION TOOL AND METHOD

FIELD

The improvements generally relate to the field of electronic access control locks, and more specifically to electric strikes thereof.

BACKGROUND

Electronic access control locks are a type of lock having an electric strike 108 in which the keeper 125 is normally blocked and prevents movement of the bolt or latch out of the socket, thereby preventing the opening of the associated door. The electric strike 108 is provided with an actuator which allows to selectively unblock the keeper 125, typically via an electronic access control means. Typically, some form of input module is provided to receive a user input (code, electronic access card, biometric, etc), and some form of authenticating function is provided, which triggers the unblocking of the keeper 125 via the actuator only if the user input is authenticated.

Electric strikes 108 are typically designed to be assembled to a metal door frame. One example of a metal door frame is presented in FIG. 1A. This example metal door frame 100 more specifically has an factory-made, ANSI standard, strike plate aperture 112 formed in a rabbet 102 of its lock jamb 110. The strike plate aperture 112 is designed to receive a standard ANSI flat, non-electric strike against two flaps 120, which are slightly recessed within the strike aperture 112, in the top and in the bottom of the aperture, respectively. Each one of these flaps 120 serves as a stop allowing the strike's surface to be flush with the surface of the rabbet 102, between the face 104 of the jamb 110 and the stop 116, and each one of these flaps 120 has a threaded aperture 124, into which an attachment screw 301 can be used to hold the strike plate firmly against the flaps 120.

In order to assemble an electric strike 108, an additional cutout must be made in the face 104 of the lock jamb 110, in the form of a transversal extension to the depth-wise oriented strike plate aperture 112 formed in the rabbet 102 of the lock jamb 110, to provide room for the actuated keeper 125 (See FIG. 1B). This additional cutout is shown in FIGS. 1C and 1D.

While electric strikes 108 are widely used, and electronic access control locks are very popular, there remained room for improvement in the installation process. Indeed, the additional cutout, which can be referred to herein as the electric strike aperture 106, was performed in an artisanal manner, and different installers had different cutting methods, such as sawing, drilling, using a Dremel™, etc. This process was less than ideal and presented a number of inconveniences. It could be resource intensive, time consuming, and typically generated a lot of noise, which is typically undesired, especially in the context of a retrofit application where people are working in the area. The accuracy depended significantly on the worker's skill, and it was common for cuts to be visibly crooked/jagged in addition to exhibiting rough edges, and other unaesthetic aspects, such as visible burns on the frame. To deal with some of the aforementioned issues, it was known to use trims 126, such as shown in FIGS. 1C and 1D, which were installed along the edges of the electric strike aperture 106, in an effort to provide a clean finish to the periphery of the keeper 125. This represented additional costs and opinions varied as to its aesthetic appearance. Moreover, the cutting process typically generated metal filings and/or grinding/sanding metal dust.

SUMMARY

It was found that many of the afore-mentioned inconveniences could be overcome by providing a specialized tool 200 to form the additional cutout forming the electric strike aperture 106. This tool 200 can work on the basis of the punch/die principle, with a frame which can be mounted snugly to the lock jamb 110, at the right area, and actuated to pull the punch 214 into the die 210 across the relevant portion of the face 104 of the lock jamb 110.

Accordingly, in accordance with one aspect, there is provided: a tool 200 for cutting an electric strike aperture 106 in a lock jamb 110 of a metal door frame 100, the lock jamb 110 having a rabbet 102 having a depth extending from a face 104 to a stop 116, and a strike plate aperture 112 defined transversally across the rabbet 102, the tool 200 comprising a face member 204 having a die aperture 210, a rabbet member 202 protruding normal to the face member 204, a jamb area 212 between the rabbet member 202 and the face member 204, and a punch 214 in the jamb area 212, the punch 214 being slidable into the die aperture 210 along a punch path 216, and an actuator 217 to move the punch 214 along the punch path 216, wherein during use, the jamb 110 can be positioned into the jamb area 212 of the tool 200 by inserting the punch 214 through the strike plate aperture 112, with the rabbet member 202 in abutment with the rabbet 102 and the face member 204 in abutment with the face 104, and the actuator 217 can be actuated to pull the punch 214 into the die aperture 210, thereby cutting the electric strike aperture 106 in the face 104 of the lock jamb 110.

In accordance with another aspect, there is provided: a method of cutting an electric strike aperture 106 in a lock jamb 110 of a metal door frame 100 using a tool 200, the method comprising: positioning the lock jamb 110 into a jamb area 212 of the tool 200, with a rabbet member 202 of the tool 200 abutting against a rabbet 102 of the lock jamb 110, a face member 204 of the tool 200 abutting against a face 104 of the lock jamb 110, and a punch 214 extending through a strike plate aperture 112 defined in the rabbet 102; and pulling the punch 214 along a punch path 216, against and through a portion of the face 104 of the lock jamb 110, into a die aperture 210 provided in the face member 204, thereby cutting the electric strike aperture 106 in the lock jamb 110.

Many further features and combinations thereof concerning the present improvements will appear to those skilled in the art following a reading of the instant disclosure.

DESCRIPTION OF THE FIGURES

In the figures,

FIG. 3A to 3E is a sequence of views showing the cutting out of an electric strike aperture using a specialized tool, in accordance with an embodiment.

DETAILED DESCRIPTION

Figure 2B:
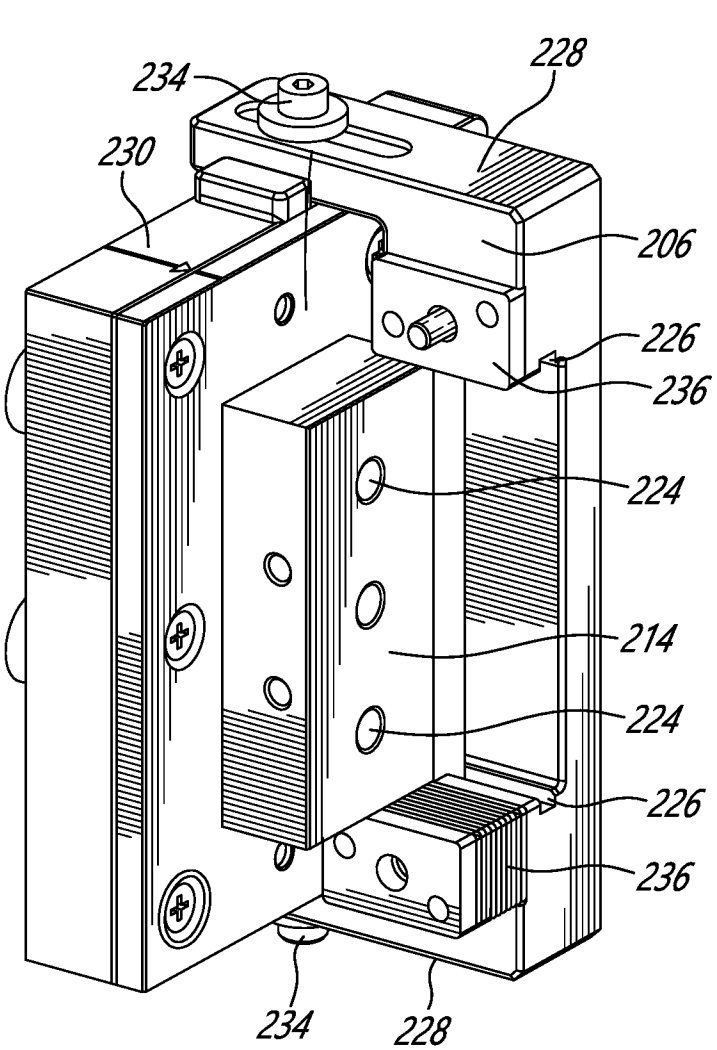
FIGS. 2A and 2B are perspective views of an embodiment of the tool, with a punch deployed and retracted, respectively.
Figure 2A:
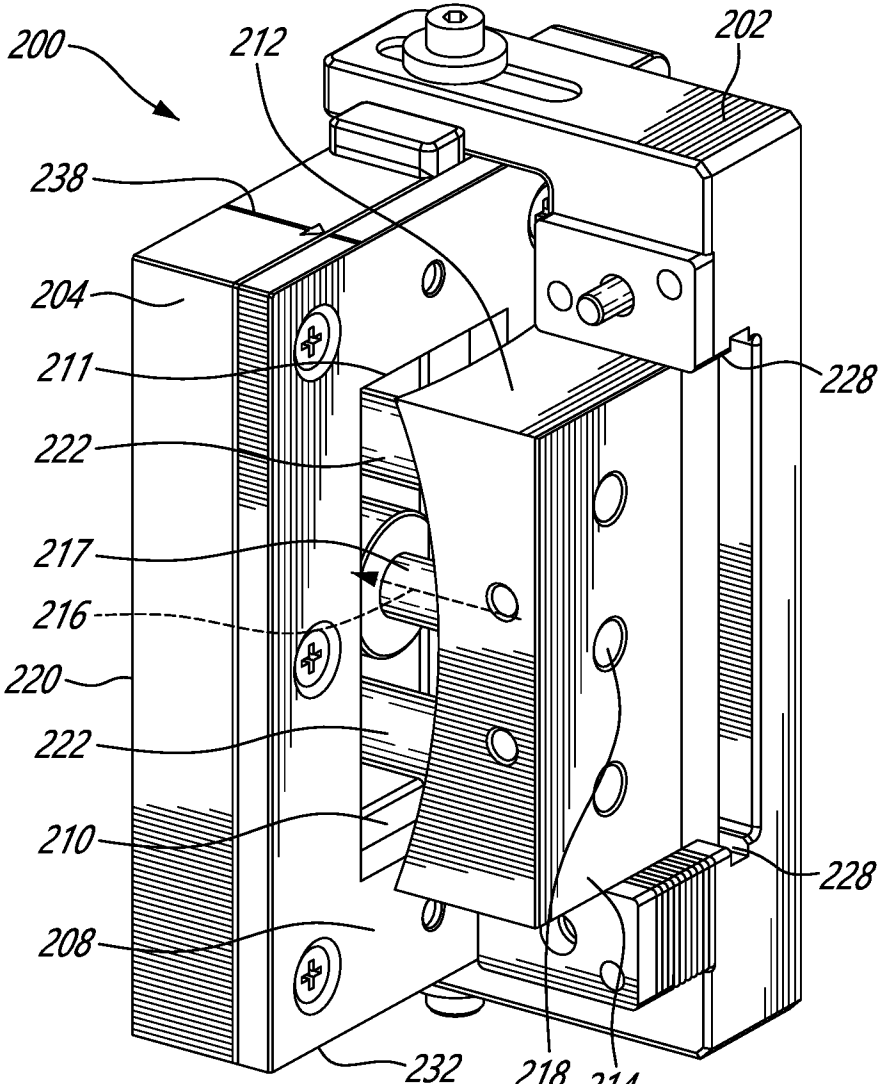

FIGS. 2A and 2B show a tool 200 for making a cutout in a metal frame 100 to accommodate an electric strike 108, in accordance with an embodiment. In this example, the tool 200 can generally be seen to have two main frame elements 202, 204 forming an internal corner, and designed to receive a corresponding corner portion of the jamb 110 in snug abutment therein and thereagainst. More specifically, a first one of these elements will be referred to as the rabbet member 202, since it is designed to be placed in snug abutment against the rabbet 102 of the door frame 100, and the second one of these elements will be referred to herein as the face member 204, as it is designed to be placed into snug abutment against the face 104 of the door frame 100. The internal face of these two elements 206, 208 will be understood to be at least somewhat normal to one another and form an internal corner delimiting an area which can be referred to herein as a jamb area 212, since it is designed to receive the corresponding portion of the jamb 110. The face member 204 has a die aperture 210 formed in its internal face 208, and a punch 214 is slidingly mounted for movement along a punch path 216 leading to the die aperture 210, in a manner that the punch 214 can be pulled from the position shown in FIG. 2A, to the position shown in FIG. 2B, using a suitable actuator, and thereby "punch" the cutout forming the electric strike aperture 106 in the face 104 of the lock jamb 110.

More specifically, FIG. 3A shows another embodiment of the tool, a prototype in this case, in its operating position with the corresponding portion of the door jamb 110 snugly engaged in the internal corner forming the jamb area 212. This can be achieved by sliding the tool 200 transversally with the face member 204 sliding against the face 104 of the door frame 100, while inserting the deployed punch 214 (FIG. 2A) at least partially into the door frame 100 through the strike plate aperture 112.

The actuator used to pull the punch 214 across the corresponding portion 106 of the door frame 100 can vary from one embodiment to another. In this embodiment, it is provided in the form of a suitable mechanical screw, referred to herein as an actuator screw 217. As better shown in FIG. 2A, the threaded length of the actuator screw 217 can extend across the face member 204, into a corresponding threaded bore 218 defined in the punch 214, and the head of the actuator screw 217 can rest against the outer face 220 of the face member 204, in a manner that upon rotation of the actuator screw 217, and as the punch 214 is guided in a manner not to rotate, the punch 214 will be pulled along the length of the thread. In still other embodiments, the actuator can be powered, rather than manually operated, for instance. There are many different ways to prevent the punch 214 from rotating, and thereby essentially providing a sliding guide to the punch 214 along the punch path 216 leading into the die 210. Generally, the mechanism which can be used to prevent the punch from rotating while allowing it to translate along the punch path can be referred to as the guiding mechanism.

In one embodiment, the guiding mechanism can be based on a punch which can simply have a slide edge which is very close to the inner face of the rabbet member, for instance, and the die can only have three edges. In the illustrated embodiment, however, it was preferred to provide a die 210 having four edges 211, and for the guiding mechanism to be relatively precise, and to this end, two guiding shafts 222 were used, one above the actuator screw 217, and one below, with corresponding bores 224 formed through the face member 204, in a manner that as the actuator screw 217 pulls the punch 214 into the die 210, the guiding shafts 222 slide snugly though the corresponding bores 224. Moreover, in this specific example, an additional guiding mechanism was provided in the form of corresponding, mating shapes defined in the lateral edge of the punch, and in the rabbet member 202. More specifically, a recess 226 is formed in the inner face 206 of the rabbet member 202, and this recess 226 is formed with an upper groove and a lower groove. The upper groove and the lower groove form keypaths into which corresponding upper and lower protruding features 228 of the punch 214 are engaged, such that when the punch 214 is pulled along the punch path 216, the protruding features 228 slide along the keypaths. Various alternate embodiments are possible. In one embodiment, for instance, the guiding shafts can be used without keypaths, whereas in another, the keypaths can be used without the guiding shafts, to name another example.

Referring back to FIG. 3A, it will be understood that in some circumstances, if the punch 214 is to reach the edge of the lock jamb's face 104 which leads to the strike plate aperture 112, and be pulled in its center of force to allow for a smooth sliding, the actuator screw 217 may need to extend across the lock jamb's face 104. In this embodiment, the upper and lower guiding shafts 222 also need to extend across the lock jamb's face 104. To this end, the tool 200 is first positioned in its operation configuration as shown in FIG. 3A, with the punch 214 unassembled thereto, and a marker can be used to mark the axial locations of the apertures on the lock jamb face 104, across the face member 204. The tool 200 can then be removed in order to form the required apertures 300 in the lock jamb face 104. These apertures 300 can simply be drilled, preferably oversized, though the lock jamb face 104 (see FIG. 3B), alternatively the apertures 300 can be punched through the lock jamb face 104, using a hand or pneumatic puncher for instance, or the area of the apertures 300 can be cut out using metal shears, a saw, or a Dremel™, to name some examples. This can represent significantly less work than cutting the entire electric strike cutout, and can be done quickly as precision is not required at this stage. The tool 200 can then be repositioned onto the lock jamb 110, as shown in FIG. 3C, this time with the punch 214 assembled to it and slid into the door frame's cavity through the strike plate aperture 112, in a manner for the apertures 300 formed in the lock jamb face 104 to accommodate the corresponding movement of the actuator screw 217 and/or of the guiding shafts 222.

With the tool 200, including the punch 214, in the operation position such as shown in FIG. 3C, the actuator can be operated to move the punch 214 along the punch path 216, against the inner face of the lock jamb's face 104, and into the die 210, which can efficiently form a perfectly shaped cutout for the electric strike aperture 106, as shown in FIG. 3D. Once the tool 200 is removed, the cutout 302 can remain trapped into the die 210, and be removed by operating the actuator in the reverse direction, such as shown in FIG. 3E.

Figure 1B:
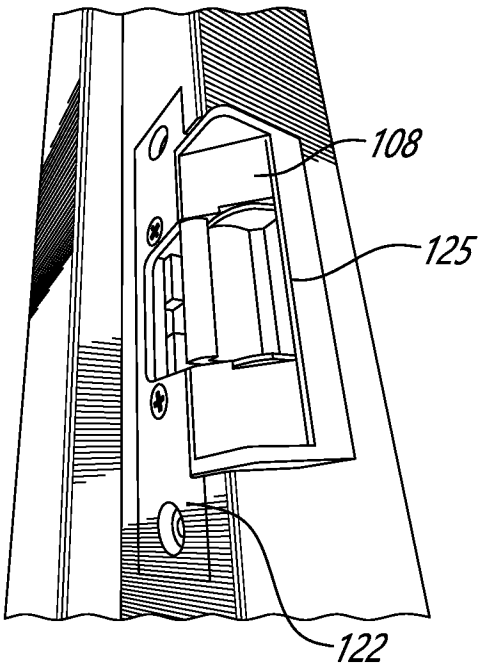
FIG. 1B is a view similar to FIG. 1A wherein an electric strike has been installed, with FIGS. 1C and 1D showing intermediary installation steps.
Figure 1A:
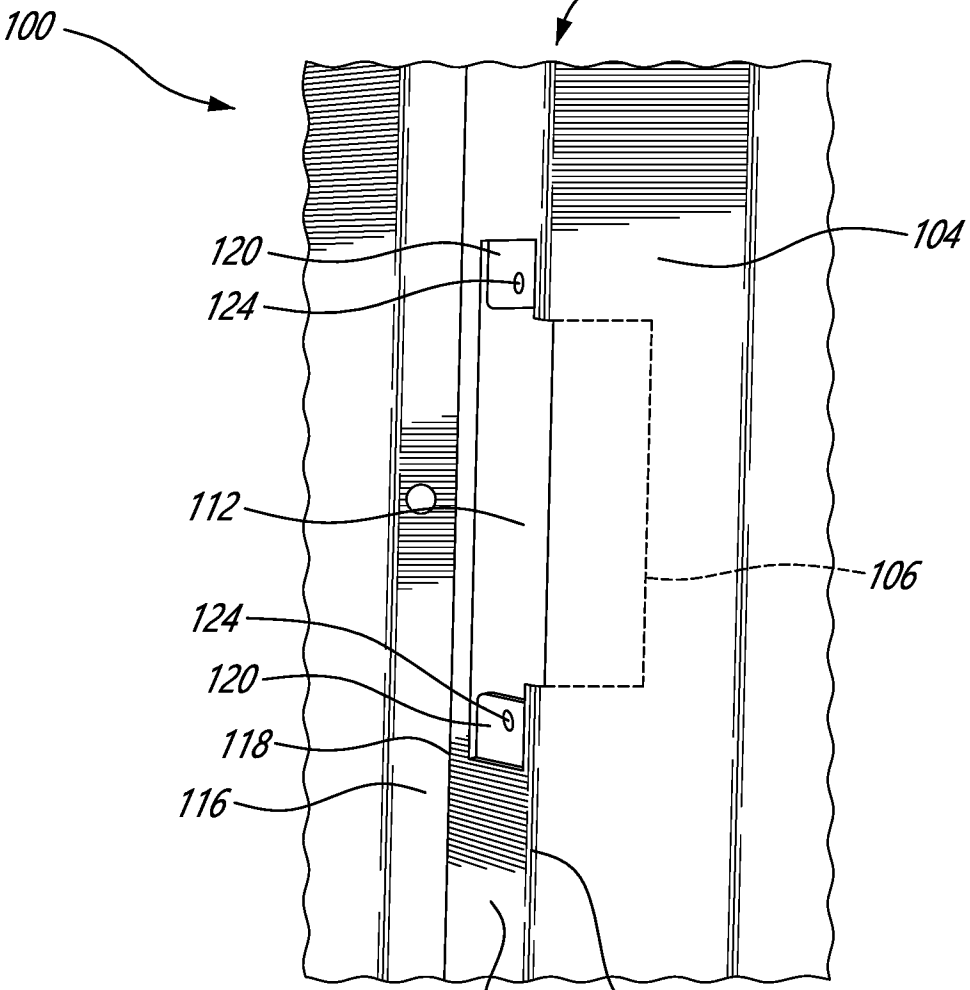
FIG. 1A is an oblique elevation view of an example of a portion of a lock jamb of a metal door frame, including a strike plate aperture thereof.
Figure 1D:
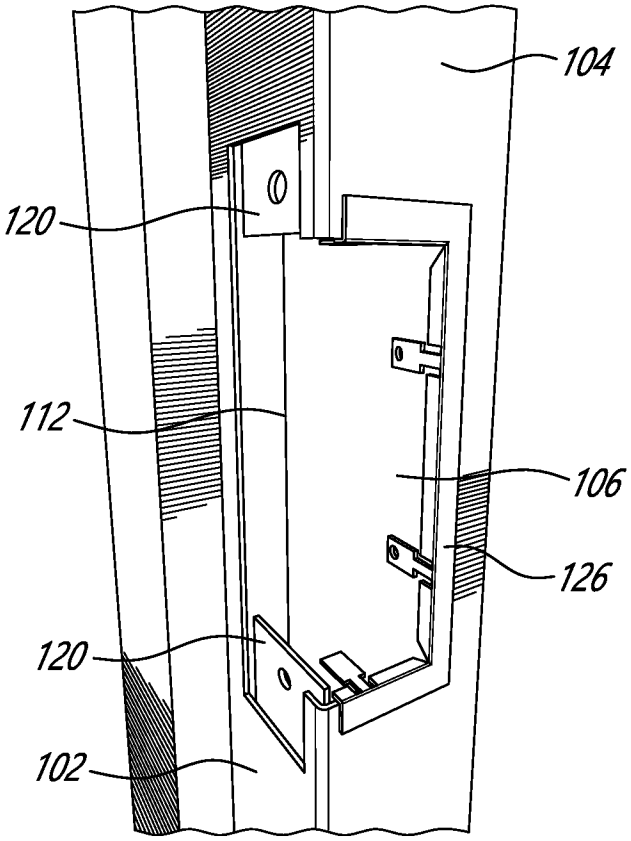
Figure 1C:
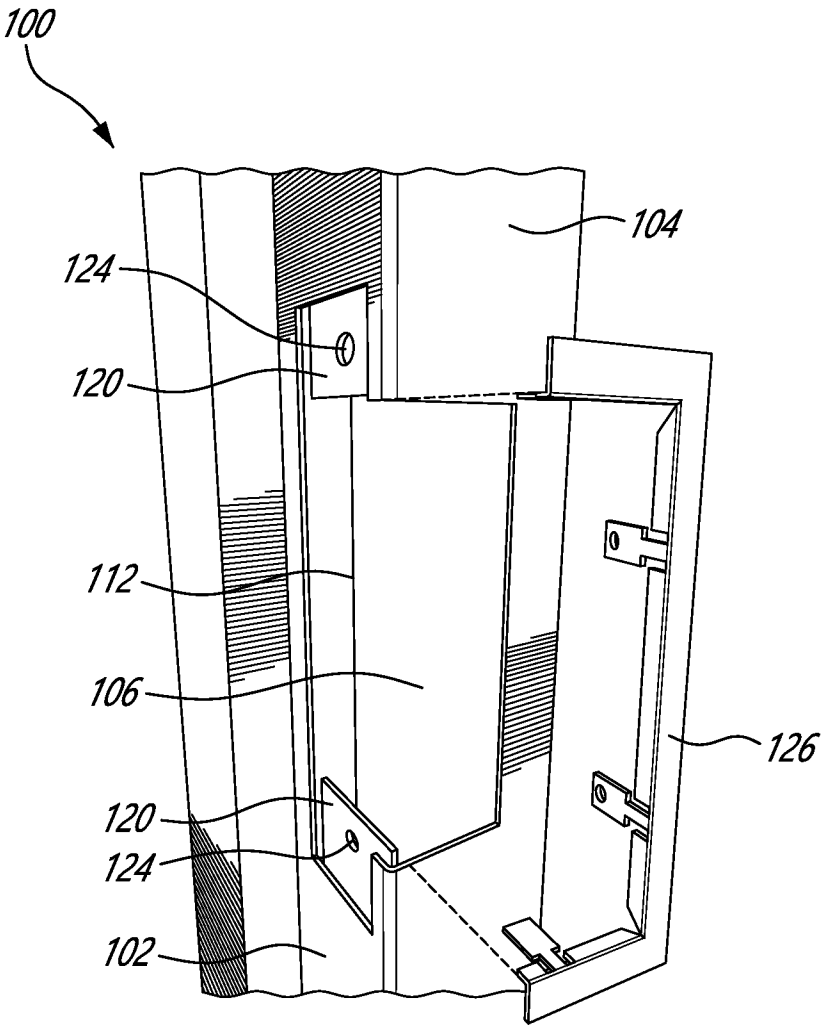

The tool can be adapted to different types of metal door frames. Many metal door frames, such as the ones shown in FIGS. 1A and 3 for instance, have a standard ANSI strike plate aperture 112 formed in a rabbet 102 thereof. The rabbet 102 is the portion of the jamb 110 which is oriented in alignment with the depth, i.e. through the door. The rabbet 102 extends from an edge 114 coinciding with an edge of the face 104 of the lock jamb 110, the face 104 being parallel to the wall surrounding the door, to an edge 118 coinciding with a stop 116 which receives the body of the door when the door is closed. Standard ANSI strike plate apertures 112 are provided with two recessed flanges 120, one at the top of the aperture 112, the other one at the bottom. These flanges 120 are recessed from the remainder of the rabbet 102 by a thickness corresponding to the thickness of the strike plate 122, for the non-electric strike plate's face to arrive flush with the remainder of the rabbet 102 when received in snug abutment in the strike plate aperture 112, against the flanges 120. The flanges 120 are typically factory-made, and also each have a corresponding threaded apertures 124. These threaded apertures 124 are designed to coincide with apertures formed in standard strike plates (similar to the ones shown in the corresponding portion of the electric strike shown in FIG. 1B for instance), and designed to receive attachment screws with countersunk heads to secure the strike plate to the lock jamb 110.

When adapting the tool 200 to metal door frames having standard ANSI strike plate apertures 112, using corresponding attachment screws 301 to secure the tool 200 in its operation position, with the attachment screws 301 engaged into the standard strike plate threaded apertures 124 across the rabbet member 102, can be a very suitable, efficient, and highly precise way of holding the tool 200 in its operation position. It will be understood, however, that other means of securing the tool 200 to its operation position may be preferred in alternate embodiments, such as to adapt the tool 200 to metal door frames which do not have standard ANSI strike plate apertures 112.

Even in the case of door frames having standard ANSI strike plate apertures 112, the depth of the rabbet 102 can vary from one model to another. To accommodate this, it may be useful to provide the tool 200 with a mechanism to allow extending or retracting the rabbet member 202 relative to the internal face of the face member 208. Moreover, various models of electric strikes 108 exist, and some may have keepers 125 which are thicker than others. To accommodate this, it may be useful to provide the tool 200 with a mechanism to allow extending or retracting the die 210 relative to the internal face of the rabbet member 206. In this embodiment, both such features were provided. Firstly, the rabbet member 202 was generally formed as a C, with upper and lower sliding members 228 designed to slidingly engage an upper face 230 and a lower face 232 of the face member 204, respectively. Adjustment screws 234 can be unfastened to release the sliding movement of the rabbet member 202 normal to the face member 204, and fastened to lock the rabbet member 202 in a desired extension configuration. Secondly, the inner face 206 of the rabbet member 202 was designed with a shim plate receiver in a manner to allow selectively fastening a varying number of shim plates 236, such that the portion of the rabbet member 202 which forms the abutment with the rabbet 102, at the top of the shim plates 236, can see its relative position varied by changing the number of shims 236. This can be done in a manner for a cut mark 238, provided here on the top face 230 of the face member 204, to align with a desired depth mark made on the face 104 of the lock jamb 110, for instance. In alternate embodiments, the face member 204 can be provided with shims and with a sliding C-shape instead of the rabbet member 202, for instance, the tool 200 can be provided with alternate means of adjusting depth and width, and/or omit one or both ways of adjusting depth and width.

Figure 4:
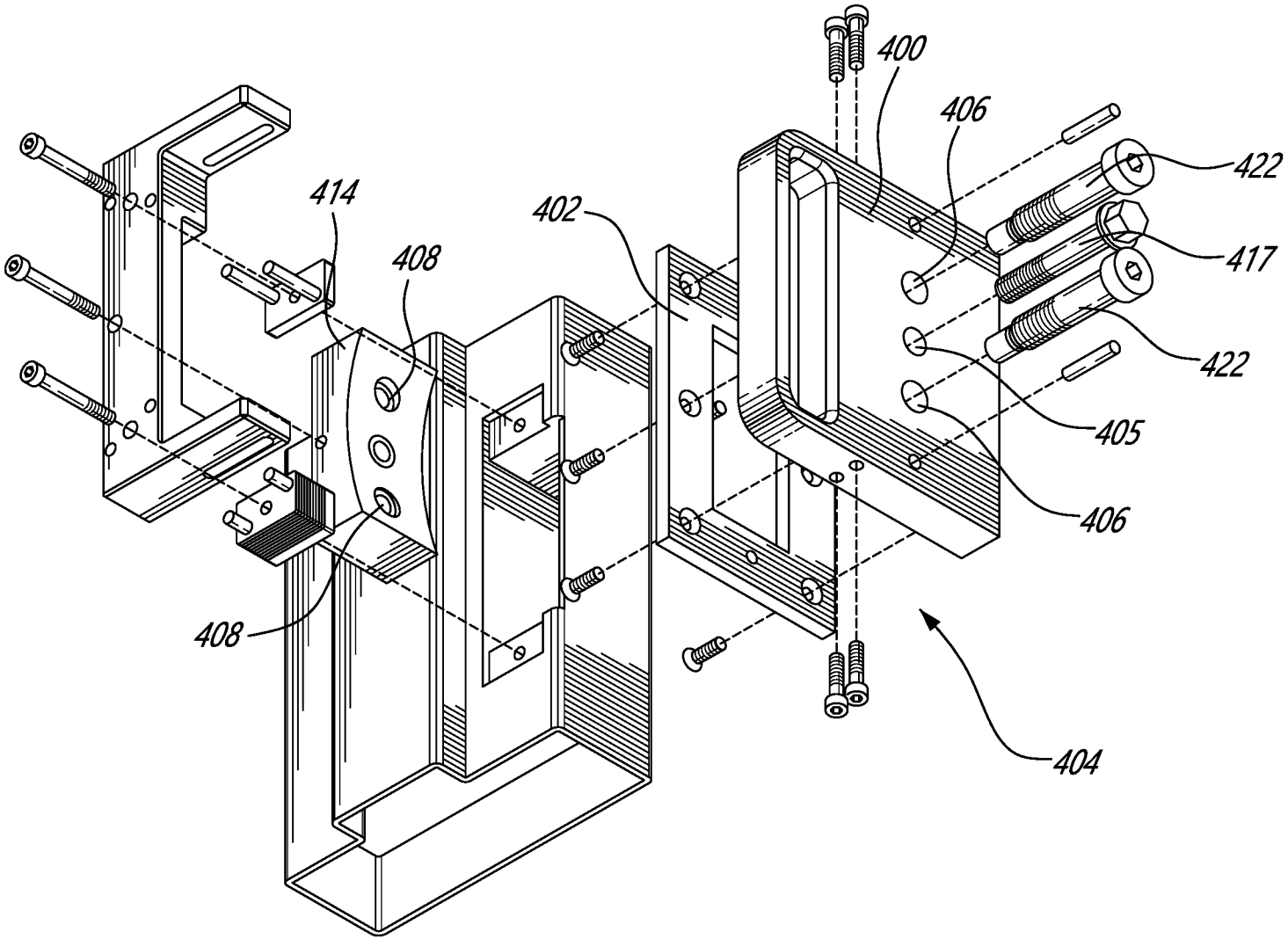
FIG. 4 is an exploded view of the tool and of the corresponding portion of the lock jamb.

More detail about one possible implementation is presented in FIG. 4. In the embodiment of FIG. 4, the face member 404 includes a frame portion 400, and a die portion 402. The die portion 402 is made of a harder material and is screwed into the frame portion 400. The frame portion has three bores 405, 406, one 405 for the actuator screw 417, and two others 406 for the two sliding guide shafts 422. The sliding guide shafts 422 are provided here in the form of shoulder bolts, with a head wider than the corresponding bore 406, a shaft portion extending slidingly across the bore 406 from the head, and a threaded tip securely screwed into corresponding female threads 408 formed in the punch 414.

As can be understood, the examples described above and illustrated are intended to be exemplary only. The scope is indicated by the appended claims.

What is claimed is:

1. A lock jamb punching tool for cutting an electric strike aperture in a lock jamb of a metal door frame, the lock jamb having a rabbet having a depth extending from a face to a stop, and a strike plate aperture defined transversally across the rabbet, the tool comprising a face member having a die aperture, a rabbet member protruding normal to the face member, a jamb area between the rabbet member and the face member, and a punch in the jamb area, the punch being slidable into the die aperture along a punch path, and an actuator to move the punch along the punch path, wherein during use, the jamb can be positioned into the jamb area of the tool by inserting the punch through the strike plate aperture, with the rabbet member in abutment with the rabbet and the face member in abutment with the face, and the actuator can be actuated to pull the punch into the die aperture, thereby cutting the electric strike aperture in the face of the lock jamb, and further wherein the rabbet member includes at least one shim plate receiver configured for selectively receiving a varying number of shim plates between the rabbet member and an abutment member configured to abut against the rabbet, said variation in the number of shim plates changing the thickness between the abutment member and the rabbet member.

2. The lock jamb punching tool of claim 1 wherein the strike plate aperture having a top threaded aperture and a bottom threaded aperture defined through corresponding flanges, the rabbet member having attachment screws configured for engaging with the threaded apertures to hold the jamb in the jamb area.

3. The lock jamb punching tool of claim 2 wherein the flanges are recessed, and the threaded apertures are spaced apart in accordance with the ANSI standard for strike plate apertures.

4. The lock jamb punching tool of claim 3 including guiding shafts, the guiding shafts slidingly extending across sliding bores of the face member and secured to the punch.

5. The lock jamb punching tool of claim 3 wherein the punch is slidingly engaged with a face of the rabbet member, the face of the rabbet member allowing the punch to slide along the punch path while preventing the punch from rotating.

6. The lock jamb punching tool of claim 3 wherein the rabbet member includes a recess, the recess forming a keypath, the punch including protruding features slidingly engaged with the keypath, the protruding features sliding along the keypath when the punch moves along the punch path.

7. The lock jamb punching tool of claim 1 wherein the actuator is an actuator screw, the actuator screw extending across the face member into engagement with a threaded actuation bore in the punch, wherein a rotation of the actuator screw pulls the punch along the punch path.

8. A lock jamb punching tool for cutting an electric strike aperture in a lock jamb of a metal door frame, the lock jamb having a rabbet having a depth extending from a face to a stop, and a strike plate aperture defined transversally across the rabbet, the tool comprising a face member having a die aperture, a rabbet member protruding normal to the face member, a jamb area between the rabbet member and the face member, and a punch in the jamb area, the punch being slidable into the die aperture along a punch path, and an actuator to move the punch along the punch path, wherein during use, the jamb can be positioned into the jamb area of the tool by inserting the punch through the strike plate aperture, with the rabbet member in abutment with the rabbet and the face member in abutment with the face, and the actuator can be actuated to pull the punch into the die aperture, thereby cutting the electric strike aperture in the face of the lock jamb, and further wherein the rabbet member is formed as a C-shape, a upper member and a lower member of the rabbet member slidingly engaged with an upper face and a lower face of the face member, for sliding normal to the face member, the rabbet member being securable to the face member to selectively block or allow said sliding.

9. The lock jamb punching tool of claim 8 wherein the strike plate aperture having a top threaded aperture and a bottom threaded aperture defined through corresponding flanges, the rabbet member having attachment screws configured for engaging with the threaded apertures to hold the jamb in the jamb area.

10. The lock jamb punching tool of claim 9 wherein the flanges are recessed, and the threaded apertures are spaced apart in accordance with the ANSI standard for strike plate apertures.

11. The lock jamb punching tool of claim 10 including guiding shafts, the guiding shafts slidingly extending across sliding bores of the face member and secured to the punch.

12. The lock jamb punching tool of claim 10 wherein the punch is slidingly engaged with a face of the rabbet member, the face of the rabbet member allowing the punch to slide along the punch path while preventing the punch from rotating.

13. The lock jamb punching tool of claim 10 wherein the rabbet member includes a recess, the recess forming a keypath, the punch including protruding features slidingly engaged with the keypath, the protruding features sliding along the keypath when the punch moves along the punch path.

14. The lock jamb punching tool of claim 8 wherein the actuator is an actuator screw, the actuator screw extending across the face member into engagement with a threaded actuation bore in the punch, wherein a rotation of the actuator screw pulls the punch along the punch path.

* * * * *